US011518053B2

(12) United States Patent
Cauley, Jr. et al.

(10) Patent No.: US 11,518,053 B2
(45) Date of Patent: Dec. 6, 2022

(54) KNIFE HAVING SHEATH AND BOTTLE OPENER

(71) Applicant: AOB Products Company, Columbia, MO (US)

(72) Inventors: Dennis W. Cauley, Jr., Fayette, MO (US); James Tayon, Moberly, MO (US); Anthony Vesich, Columbia, MO (US); Matthew Kinamore, Columbia, MO (US); Curtis Smith, Columbia, MO (US); Josh Neville, Columbia, MO (US); Mark Dalton, Columbia, MO (US)

(73) Assignee: AOB Products Company, Columbia, MO (US)

( * ) Notice: Subject to any disclaimer, the term of this patent is extended or adjusted under 35 U.S.C. 154(b) by 116 days.

(21) Appl. No.: 16/927,801

(22) Filed: Jul. 13, 2020

(65) Prior Publication Data

US 2021/0008737 A1 Jan. 14, 2021

Related U.S. Application Data

(60) Provisional application No. 62/873,487, filed on Jul. 12, 2019.

(51) Int. Cl.

| | |
|---|---|
| ***B26B 11/00*** | (2006.01) |
| ***B26B 29/02*** | (2006.01) |
| ***B26B 3/00*** | (2006.01) |
| ***B67B 7/16*** | (2006.01) |

(52) U.S. Cl.

CPC ..... *B26B 11/006* (2013.01); *B26B 3/00* (2013.01); *B26B 29/025* (2013.01); *B67B 7/16* (2013.01)

(58) Field of Classification Search

CPC ..... B26B 11/006; B26B 3/00; B26B 29/02; B26B 29/025; B67B 7/16

See application file for complete search history.

(56) References Cited

U.S. PATENT DOCUMENTS

| | | | |
|---|---|---|---|
| 1,425,704 A | 8/1922 | Shek | |
| D109,695 S | 5/1938 | Calencia | |
| 2,314,504 A | 3/1943 | Lifchultz | |
| D144,225 S | 3/1946 | Teague | |

(Continued)

FOREIGN PATENT DOCUMENTS

| | | | |
|---|---|---|---|
| AT | 7468 U1 * | 4/2005 | ..... B26B 3/02 |
| CH | 711489 B1 * | 1/2020 | ..... B23D 51/00 |

(Continued)

OTHER PUBLICATIONS

Bubba Proteus Ulu Knife, $32.99 online on sportsmansguide.com, review Dec. 2020, 3 pages.

(Continued)

*Primary Examiner* — David B. Thomas
(74) *Attorney, Agent, or Firm* — Stinson LLP

(57) ABSTRACT

A knife, components thereof, a sheath therefor, and associated methods. The sheath may be releasably retainable on the blade by engagement of connection structure of the sheath and blade formed by inserting the blade into the sheath. The blade may include a bottle opener. The knife may include a finger recess adapted to receive a finger of a user when the knife is gripped by the user. The knife may be an ulu knife.

19 Claims, 6 Drawing Sheets

(56) References Cited

U.S. PATENT DOCUMENTS

| | | | | |
|---|---|---|---|---|
| D220,598 | S | 4/1971 | Meszaros | |
| 3,853,283 | A | 12/1974 | Croce et al. | |
| D249,994 | S | 10/1978 | Hall | |
| D263,112 | S | 2/1982 | Ressel | |
| 4,574,479 | A | 3/1986 | Gramann | |
| 4,817,221 | A | 4/1989 | Ryan | |
| D330,665 | S | 11/1992 | Neuendorf | |
| D352,426 | S | 11/1994 | Tucker | |
| D353,989 | S | 1/1995 | Watson | |
| 5,377,626 | A | 1/1995 | Kilsby et al. | |
| D392,078 | S | 3/1998 | Courts | |
| 5,762,029 | A | 6/1998 | DuBois et al. | |
| D409,270 | S | 5/1999 | Balolia | |
| 6,205,667 | B1 * | 3/2001 | Glesser | B26B 1/08 30/162 |
| D457,790 | S | 5/2002 | Wang et al. | |
| D475,591 | S | 6/2003 | Luquire | |
| 6,792,893 | B1 | 9/2004 | Quintero et al. | |
| 6,851,215 | B2 | 2/2005 | Conrad | |
| 6,925,967 | B1 | 8/2005 | Woodruff | |
| 7,040,257 | B2 | 5/2006 | Waxman et al. | |
| 7,131,401 | B2 | 11/2006 | Huff et al. | |
| 7,207,296 | B2 | 4/2007 | DiDonato | |
| D572,563 | S | 7/2008 | McRoberts et al. | |
| D612,694 | S | 3/2010 | Eide et al. | |
| 7,784,728 | B2 | 8/2010 | Shi | |
| D640,105 | S | 6/2011 | Benz | |
| 8,069,570 | B2 * | 12/2011 | Taylor | B25F 1/00 224/232 |
| D662,787 | S * | 7/2012 | Holmes | D7/649 |
| 8,251,020 | B2 | 8/2012 | Matthews | |
| 8,256,384 | B2 | 9/2012 | Wheeler et al. | |
| 8,256,385 | B2 | 9/2012 | Goldenberg | |
| 8,347,825 | B2 | 1/2013 | Lopez et al. | |
| D681,081 | S | 4/2013 | Neal, Jr. et al. | |
| D730,145 | S | 5/2015 | Eriksson et al. | |
| D742,192 | S | 11/2015 | Morales | |
| 9,247,717 | B2 | 2/2016 | Hurwitz | |
| D765,319 | S | 8/2016 | Chefez et al. | |
| 9,414,572 | B2 | 8/2016 | O'Brien et al. | |
| 9,717,218 | B2 | 8/2017 | O'Brien et al. | |
| D811,837 | S | 3/2018 | Brandes | |
| D832,072 | S | 10/2018 | McGinnis | |
| D833,843 | S | 11/2018 | Stahle, Jr. | |
| 10,363,675 | B2 * | 7/2019 | Robinson | B26B 3/00 |
| 10,420,327 | B2 | 9/2019 | Zhu et al. | |
| D873,708 | S | 1/2020 | Paik et al. | |
| 10,582,700 | B2 | 3/2020 | Vilardi et al. | |
| 10,702,084 | B2 | 7/2020 | Knapp | |
| D903,040 | S | 11/2020 | Dark, II | |
| D911,795 | S | 3/2021 | Su | |
| 11,134,657 | B2 | 10/2021 | Tang et al. | |
| 2004/0237906 | A1 | 12/2004 | Waxman et al. | |
| 2006/0162674 | A1 | 7/2006 | Neiser | |
| 2006/0162675 | A1 | 7/2006 | Ghalebi et al. | |
| 2006/0201450 | A1 | 9/2006 | Jordan et al. | |
| 2006/0266300 | A1 | 11/2006 | Perkitny | |
| 2010/0302767 | A1 | 12/2010 | Mattheis | |
| 2014/0251098 | A1 | 9/2014 | Qian | |
| 2018/0200903 | A1 * | 7/2018 | Robinson | B26B 3/00 |
| 2019/0054642 | A1 * | 2/2019 | Wu | B26B 3/06 |
| 2019/0351570 | A1 * | 11/2019 | Siffermann | B26B 3/06 |

FOREIGN PATENT DOCUMENTS

| | | | | |
|---|---|---|---|---|
| CN | 108858292 A | * | 11/2018 | B26B 29/02 |
| DE | 7468 U1 | * | 4/2005 | B26B 3/02 |
| KR | 20140081637 A | * | 7/2014 | B26B 11/006 |
| TW | M541937 U | * | 5/2017 | B26B 29/025 |

OTHER PUBLICATIONS

Bubba Blade Proteus Ulu Knife, Item No. 1989606, $39.95, online on Smokey Moutain Knife Works, smkw.com, review by David P. on Nov. 30, 2020, 3 pages.

* cited by examiner

KNIFE HAVING SHEATH AND BOTTLE OPENER

CROSS-REFERENCE TO RELATED APPLICATION

This application claims the benefit of U.S. Provisional Application No. 62/873,487, filed Jul. 12, 2019, the entirety of which is hereby incorporated herein by reference.

FIELD

The present disclosure generally relates to cutting implements, and more particularly to knives.

BACKGROUND

Many types of knives are used for various tasks. Knives having different types of blades are used in different circumstances. A user may own a variety of knives having blades ranging from small to large in size, and having different blade features, such serration, flexibility, etc.

SUMMARY

In one aspect, a knife assembly comprises a knife including a handle and a blade. The blade has a cutting edge. The sheath defines a pocket in which the blade is receivable for protecting the cutting edge. The blade comprises sheath engagement structure, and the sheath comprises blade engagement structure. The blade engagement structure is configured to engage the sheath engagement structure for releasably retaining the blade in the sheath pocket. At least one of the blade engagement structure or the sheath engagement structure includes an abutment surface that, when the blade is in the sheath pocket, faces away from the handle and is located to abut the other of the blade engagement structure or the sheath engagement structure to obstruct movement of the sheath away from the handle to releasably retain the blade in the sheath pocket.

In another aspect, a knife for removing a bottle cap from a bottle comprises a handle and a blade connected to the handle. The blade includes a cutting edge and a bottle opener. The bottle opener comprises a cap receiving opening, a fulcrum portion, and a prying portion. The fulcrum portion and prying portion are arranged with respect to the cap receiving opening such that the fulcrum portion and prying portion are engageable with the bottle cap while the bottle cap is received in the cap receiving opening. The blade is pivotable about the fulcrum portion while the bottle cap is received in the cap receiving opening and in engagement with the fulcrum portion to pry the bottle cap off the bottle with the prying portion.

In yet another aspect, an ulu knife comprises a handle including a grip. The grip has an upper side, a lower side, a forward side, a rearward side, and opposite left and right ends. The handle has a length extending between the opposite left and right ends. The ulu knife includes a blade connected to the handle and extending downward away from the grip to a cutting edge below the grip. The blade has a forward face and an opposite rear face. At least one of the left and right ends of the grip includes a finger recess at least partially bounded by a forward wall and a rear wall having the finger recess therebetween. The finger recess is located to receive a thumb of a user's hand while other fingers of said hand grasp the grip with the palm of the hand against the upper side of the grip.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
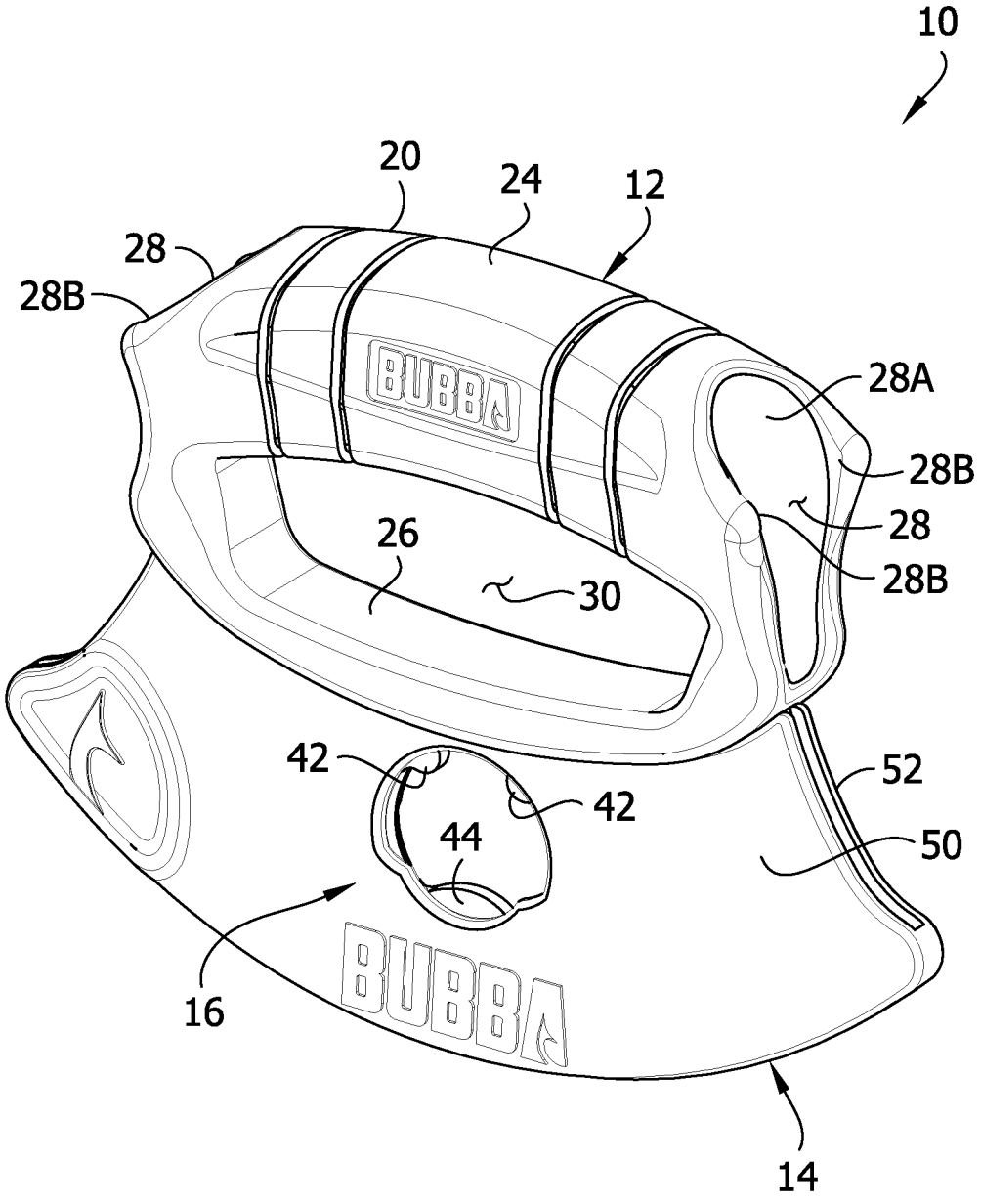
FIG. 1 is a front perspective of a knife assembly including a knife and a sheath.

Referring to FIG. 1, a knife assembly of the present disclosure is indicated generally by the reference number 10. The knife assembly includes a knife 12 and a sheath 14. The knife 12 is of the type commonly referred to as an ulu knife. As will be explained in further detail below, the knife assembly 10 includes a bottle opener 16 and connection structure for securing the sheath 14 in position on the knife 12. It will be appreciated that aspects of the knife can be implemented on other types or configurations of knives (e.g., knives other than ulu knives), without departing from the scope of the present disclosure.

Figure 2:
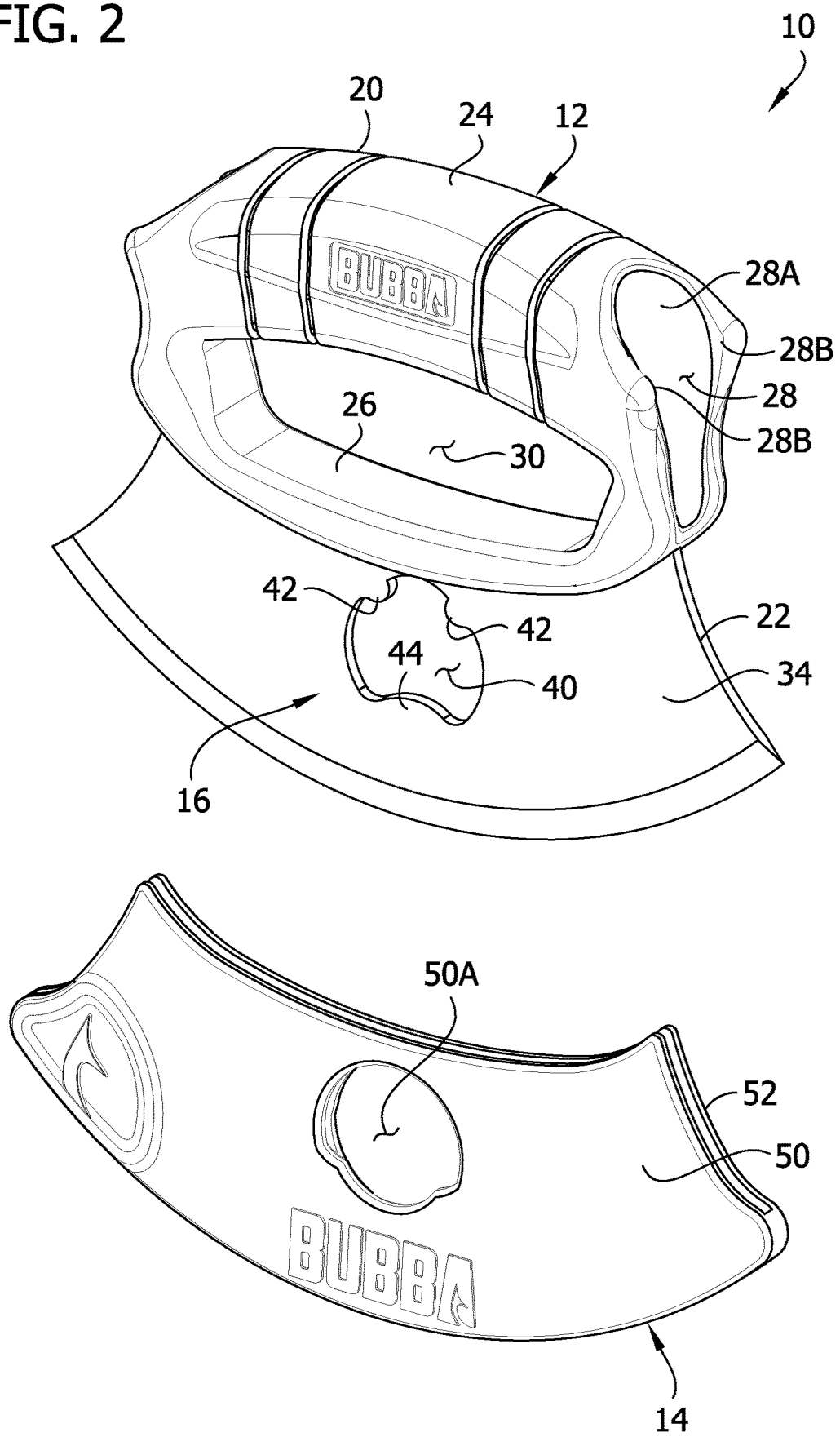
FIG. 2 is a front perspective of the knife and sheath separated from each other.
Figure 3:
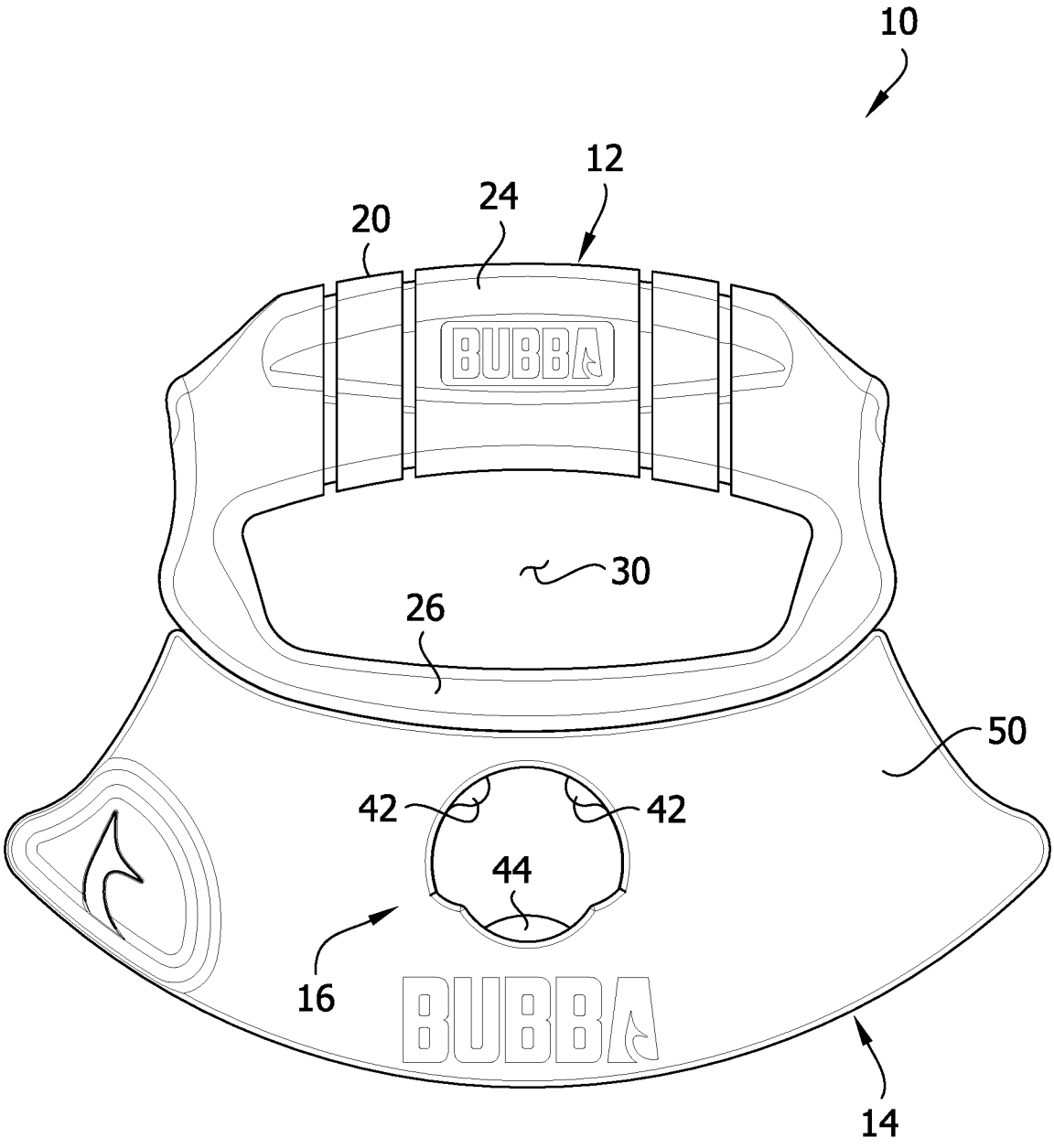
FIG. 3 is a front elevation of the knife assembly.
Figure 4:
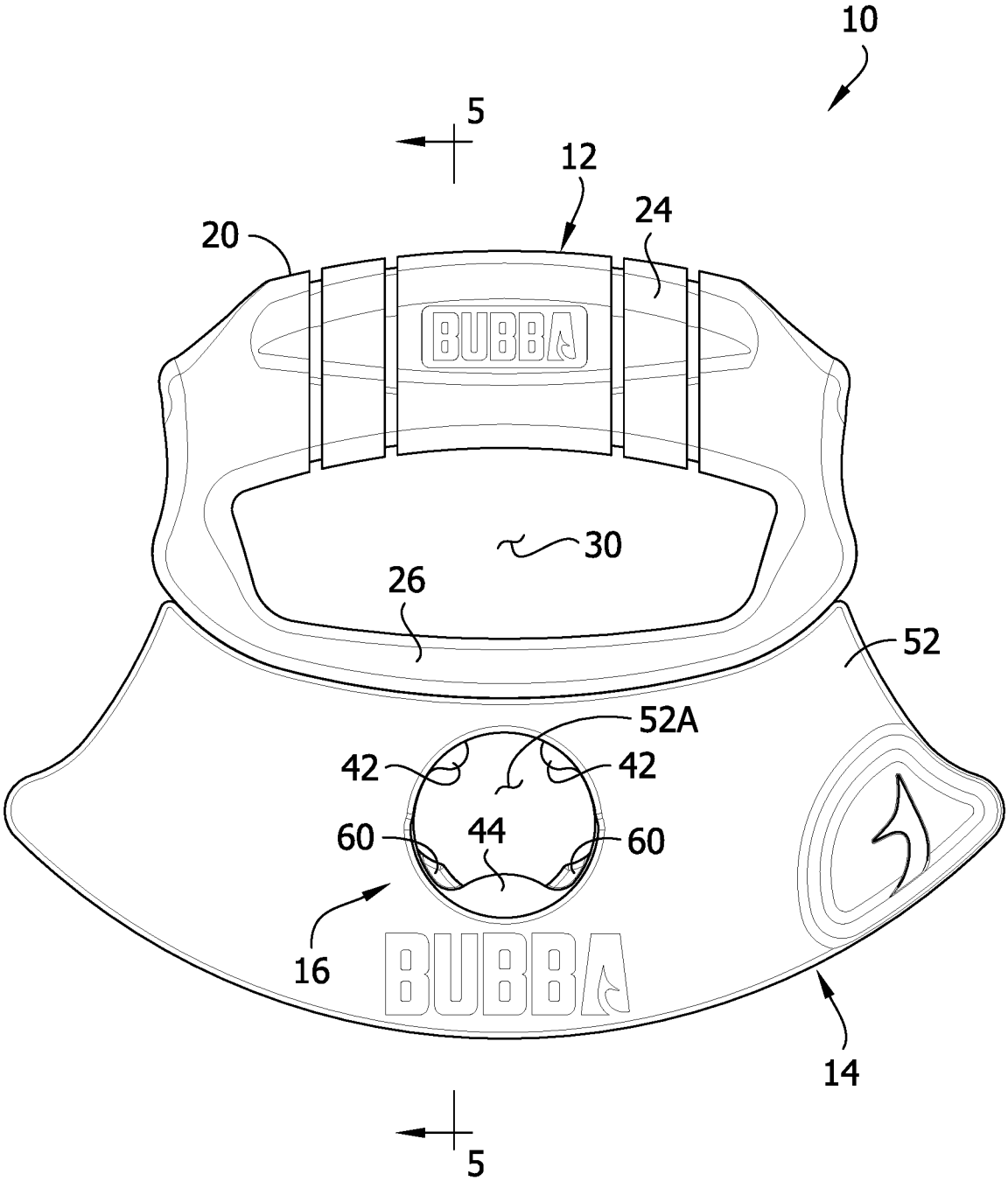
FIG. 4 is a rear elevation of the knife assembly.

The knife 12 includes an upper handle 20 and a blade 22 extending downward below the handle. The handle 20 includes a grip 24 and a blade connecting portion 26. The blade 22 extends downward, away from the connecting portion 26. The grip has an upper side (facing upward in FIG. 2), a lower side (facing the blade connecting portion 26), opposite left and right ends (e.g., defining recesses 28), and a length extending between the left and right ends. The grip 24 includes arms at its opposite ends connecting the grip to the blade connecting portion 26. The grip 24 is configured to receive fingers of a user's hand wrapped on the grip. The two recesses 28 at the opposite ends of the grip are configured to receive a thumb (or other finger) of the user's hand, depending on how the user applies their hand to the handle and in which orientation the user grips the knife 12. Each recess is defined by a finger bed 28A and front and rear side walls 28B defined by protruding bolsters on front and rear sides of the recess. In the illustrated embodiment, the handle 20 defines an opening 30 configured to receive fingers of the user while the palm of the user's hand is against the top of the grip 24 and a thumb of the user rests on one of the finger beds 28A.

Figure 6:
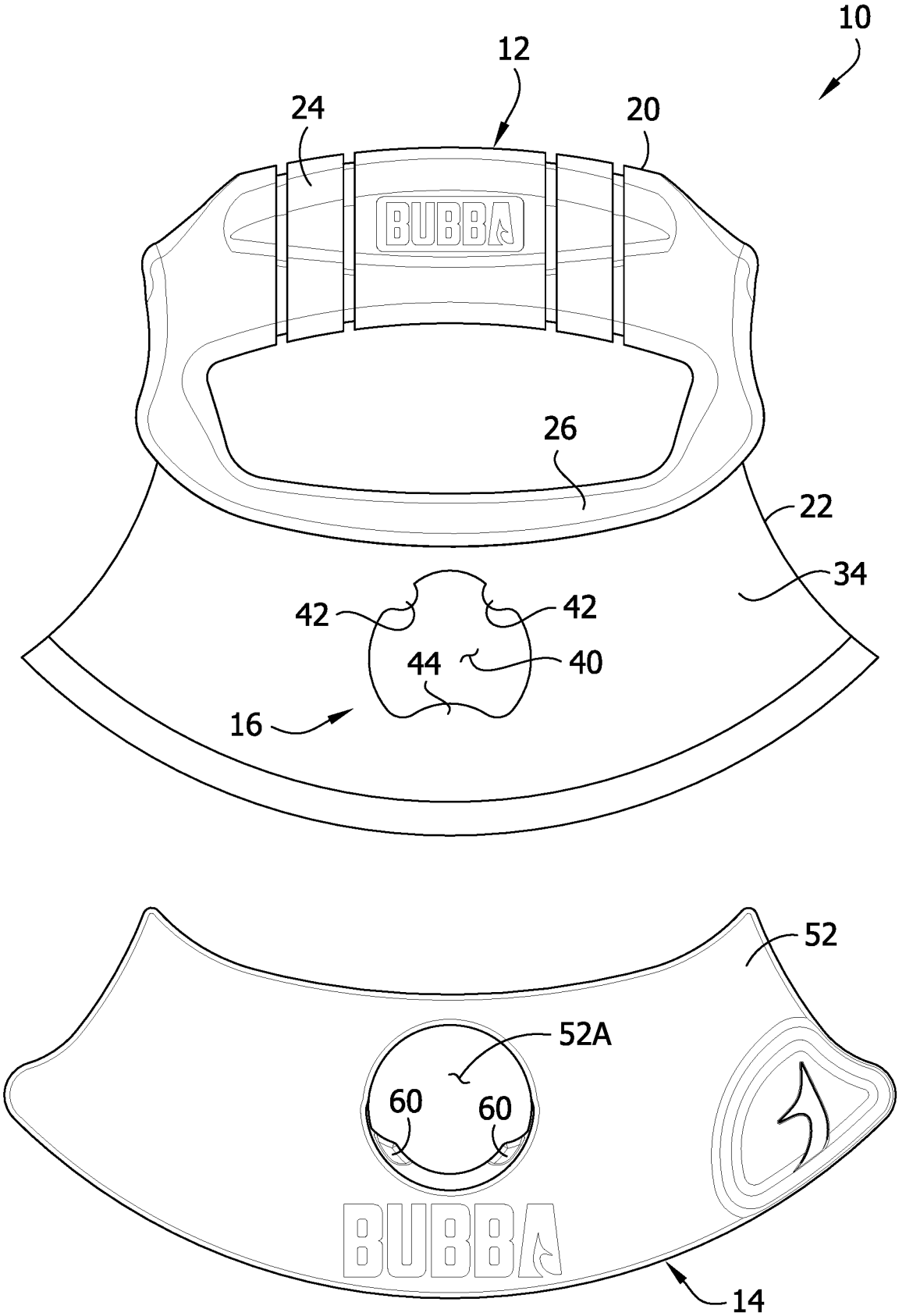
FIG. 6 is a rear elevation of the knife and sheath separated from each other.

The blade 22 includes a main body 34 having an upper or proximal portion connected to the handle 20 and a lower or distal portion defining a cutting edge of the blade spaced from the handle. The cutting edge is generally arcuate or curved and can be moved in a rocking motion or other types of motion for cutting. The blade has a forward face (facing out of the page in FIG. 2) and a rear face (facing into the page in FIG. 6) extending from the handle 20 to the cutting edge. The blade is sharpened on both sides of the blade at the cutting edge.

The bottle opener 16 is configured to remove a cap from a bottle (e.g., beverage bottle having pry off cap). In the illustrated embodiment, the blade includes the bottle opener 16. In the illustrated embodiment, the main body 34 of the blade 22 defines the bottle opener 16. The bottle opener 16 includes an opening 40 in the blade 22 in which a portion of a cap on a bottle is receivable. The bottle opener 16 includes an edge extending around the bottle opener opening. The edge is part of an edge margin extending around the opening and defining a first cap engagement portion 42 and a second cap engagement portion 44. Although the illustrated opening 40 has an edge fully surrounding the opening, it will be appreciated that other configurations (e.g., open sided opening not having fully surrounding edge) can be used without departing from the scope of the present disclosure.

In use, to remove a cap from a bottle, the bottle opener 16 is applied to the bottle such that the cap is received in the opening 40. A cap engagement portion (e.g., portion 42, or portion 44) is engaged with a top side of the bottle cap to serve as a fulcrum portion, and the other of the first or second cap engagement portions 42, 44 is engaged with an underside of a rim of the bottle cap to serve as a prying portion. The handle 20 is then moved by the user so the knife 12 acts as a lever such that the knife pivots about the engagement of the fulcrum portion with the top of the bottle cap, and the prying portion pries the underside of the rim off of the bottle mouth.

In the illustrated embodiment, the first cap engagement portion 42 comprises two protrusions extending into the bottle opener opening toward the second engagement portion 44. The protrusions 42 are spaced from each other along the edge margin of the cap receiving opening 40. The second cap engagement portion 44 comprises a single protrusion extending into the bottle opener opening toward the first cap engagement portion 42. Other configurations can be used without departing from the scope of the present disclosure. For example, the prying portion and fulcrum portion could each comprise two or more protrusions, or could each comprise one protrusion. The prying portion and/or fulcrum portion may lack a protrusion. Moreover, the blade could include material or structure connected to the main body of the blade defining the prying and/or fulcrum portions.

In the illustrated embodiment, the sheath 14 is configured to permit use of the bottle opener 16 when the sheath is installed on the knife 12. The sheath 14 includes a front wall 50 and a rear wall 52 connected to each other at distal or bottom edges of the walls. The sheath 14 defines a blade receiving pocket between the front and rear walls 50, 52. The front and rear walls 50, 52 include respective openings 50A, 52A located to be in registration with the bottle opener opening 40 when the sheath is installed on the blade. To remove a bottle cap when the sheath 14 is on the knife 12, the bottle cap can be inserted through the opening 50A, 52A in the front or rear wall 50, 52 of the sheath 14 to be received in the bottle opener opening 40 and to engage the fulcrum and prying portions 40, 42. The openings 50A, 52A in the front and rear walls 50, 52 are sized such that the fulcrum and prying portions 40, 42 are exposed through the openings 50A, 52A when the sheath 14 is installed on the blade 22 for engagement with a cap to remove the cap.

Figure 5:
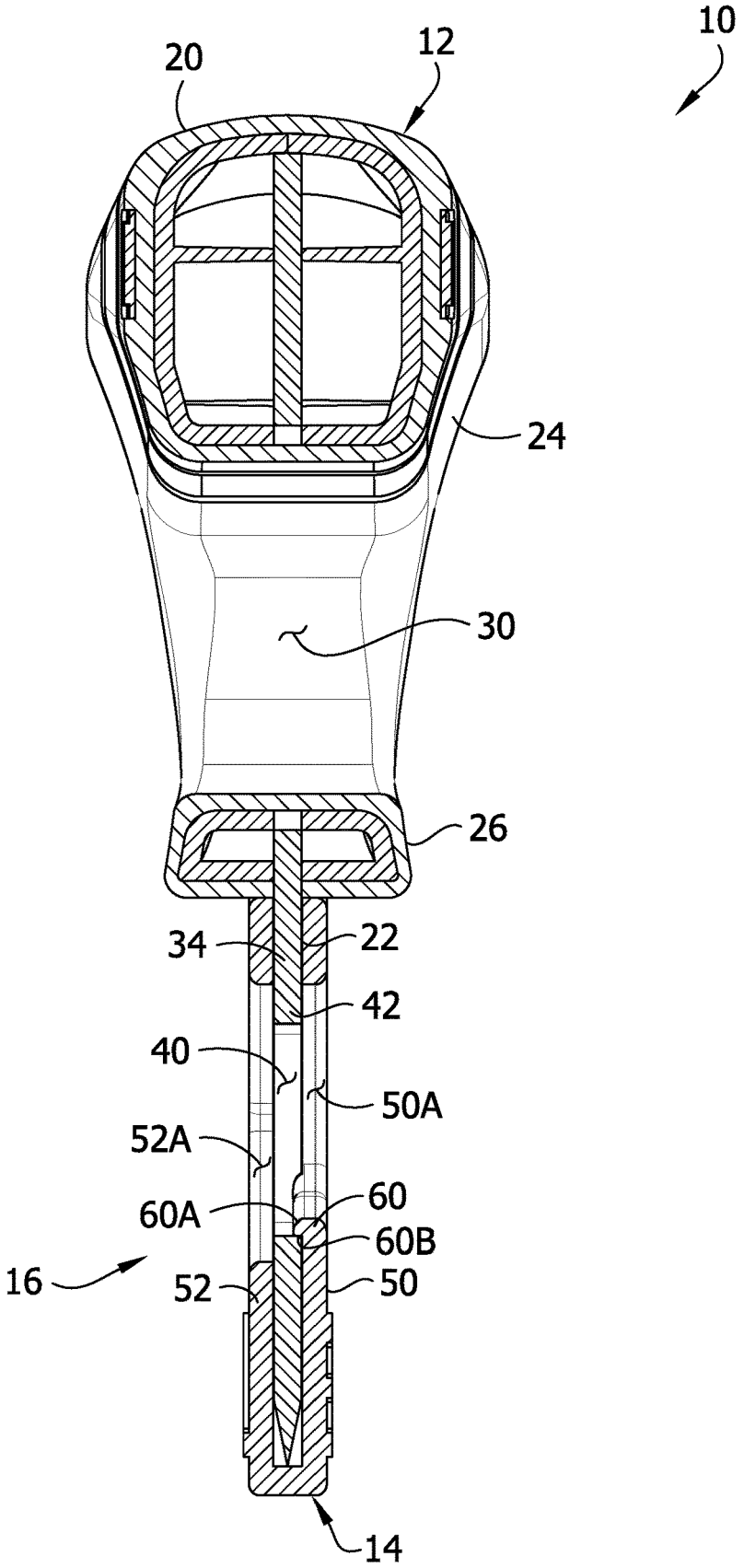
FIG. 5 is a section of the knife assembly taken in a plane including line 5-5 of FIG. 4.

In another aspect of the knife assembly 10, the sheath 14 is configured to be releasably retained on the knife 12. In particular, the sheath 14 includes bottle opener engagement structure (broadly, "connection structure" or "blade engagement structure") configured to engage the bottle opener 16 (broadly, "connection structure" or "sheath engagement structure") to releasably retain the sheath on the blade 22. The bottle opener engagement structure includes at least one catch 60 (in the illustrated embodiment, two catches 60) configured to releasably retain the sheath 14 on the blade 22 by mating with the opening 40 and releasably abutting the edge of the opening. The catches 60 (broadly, "protrusions") protrude from the front wall 50 of the sheath 14 into the blade receiving pocket and are configured to extend into the bottle opener opening 40 when the blade is received in the pocket. The latches each include a cam surface 60A and an abutment surface 60B. As the blade 22 is moved into the pocket, the cam surfaces 60A of the catches 60 slide along a surface of the blade until reaching the bottle opener opening 40, where the catches automatically enter the bottle opener opening to locate the abutment surfaces 60B to engage the edge of the bottle opener opening to obstruct the blade 22 from being inadvertently removed from the sheath 14, as shown in FIG. 5 (covering position of sheath on blade). When the catches 60 are in the opening 40, the abutment surfaces 60B face away from the handle 20 to prevent the sheath from being moved away from the handle. Desirably, the catches 60 are located to automatically enter the bottle opener opening 40 when the blade becomes fully seated in the sheath 14 (e.g., when the upper end of the sheath abuts or is close to the handle, and/or when the cutting edge of the blade is at or near the bottom of the pocket), so the sheath is securely attached to the blade 22. The first catch 60 is received in a lower portion of the bottle opener opening 40 bounded by a concave edge segment adjacent the protrusion 44. The second catch 60 is received in another lower portion of the bottle opener opening 40 bounded by a concave edge segment on the other side of the protrusion 44. The catches 60 assist in centering the sheath 14 lengthwise of the blade 22 and resist movement of the sheath away from the handle 20 and in opposite directions generally parallel to the length of the cutting edge. The sheath 14 can be removed from the blade by pulling the front wall 50 away from the blade 22 with a force sufficient to remove the latches 60 from the bottle opener opening 40 and then sliding the sheath downward or distally off the blade. Alternatively, the sheath 14 can be removed by pulling the sheath away from the handle 20 with sufficient force to dislodge the catches 60 from the bottle opener opening. Desirably, the front wall 50 is flexible and/or the connection of the front wall to the rear wall 52 acts as a living hinge to permit movement of the catches 60 out of the bottle opener opening 40. For example, the sheath could be formed of a flexible or semi-rigid plastic.

Other types and configurations of sheath engagement structure and blade engagement structure can be used without departing from the scope of the present disclosure. For example, the catch could be on the blade and the opening on the sheath. In such a case, the opening would include an abutment surface (e.g., edge portion) facing away from the handle that is located to engage the catch to obstruct movement of the sheath away from the handle and thus resist removal of the sheath from the blade. In other embodiments, other types or configurations of abutment surfaces can be used for retaining the blade in the sheath (e.g., on structure different than a catch or opening).

In a method of using the knife 12, the user removes the sheath 14 from the knife by dislodging the catches 60 from the opening 40 and moving the sheath away from the handle 20 to expose the cutting edge of the blade. While holding the handle 20 in their hand (optionally with thumb in one of the finger recesses 28), the user can push the blade 22 into an item to be cut and/or roll the curved cutting edge against a surface to cut an item on the surface. When the user is finished cutting, the sheath 14 can be reinstalled on the knife 12 by positioning the cutting edge in registration with the mouth of the sheath and moving the knife and/or blade to receive the blade in the pocket of the sheath. As the blade 22 enters the sheath pocket, the catches 60 cam on a face of the blade to temporarily resiliently deform the side wall of the sheath 14, permitting the catches to deflect outward. When the blade 22 is sufficiently received in the sheath pocket, the resilient deformation of the sheath wall causes the catches 60 to automatically enter the opening 40 thereafter obstructing removal of the blade from the sheath. With the sheath 14 on or off the knife 12, the bottle opener 16 can be used to pry a cap off a bottle.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A knife assembly comprising:

a knife including a handle and a blade, the blade having a cutting edge;

a sheath comprising a sheath body including a sheath wall portion, the sheath body defining a sheath pocket in which the blade is receivable for protecting the cutting edge, the sheath wall portion partially defining the sheath pocket;

wherein the blade comprises sheath engagement structure and the sheath wall portion comprises blade engagement structure, the blade engagement structure configured to engage the sheath engagement structure for releasably retaining the blade in the sheath pocket, at least one of the blade engagement structure or the sheath engagement structure including an abutment surface that, when the blade is in the sheath pocket, faces away from the handle and is located to abut the other of the blade engagement structure or the sheath engagement structure to obstruct movement of the sheath away from the handle to releasably retain the blade in the sheath pocket;

wherein the sheath wall portion is deformable to permit deflection of blade engagement structure from an at rest position of the blade engagement structure upon entry of the blade to the sheath pocket and to permit return of the blade engagement structure toward the at rest position when the blade is in the sheath pocket to locate the abutment surface to abut said other of the blade engagement structure or the sheath engagement structure to obstruct movement of the sheath away from the handle to releasably retain the blade in the sheath pocket.

2. A knife assembly as set forth in claim 1, wherein at least one of the sheath engagement structure or the blade engagement structure comprises an opening and the other of the sheath engagement structure or the blade engagement structure comprises a protrusion, the protrusion being receivable in the opening to releasably retain the blade in the sheath pocket.

3. A knife assembly as set forth in claim 2, wherein the protrusion is arranged to abut a surface bounding the opening to releasably retain the blade in the sheath pocket.

4. A knife assembly as set forth in claim 2, wherein the sheath engagement structure and blade engagement structure are arranged such that the protrusion automatically enters the opening and forms releasable retaining engagement with a surface bounding the opening when the blade is moved into the sheath pocket.

5. A knife assembly as set forth in claim 2, wherein the sheath engagement structure comprises the opening, and the blade engagement structure comprises the protrusion, the protrusion comprising the abutment surface.

6. A knife assembly comprising:

a knife including a handle and a blade, the blade having a cutting edge;

a sheath defining a sheath pocket in which the blade is receivable for protecting the cutting edge;

wherein the blade comprises sheath engagement structure and the sheath comprises blade engagement structure, the blade engagement structure configured to engage the sheath engagement structure for releasably retaining the blade in the sheath pocket, at least one of the blade engagement structure or the sheath engagement structure including an abutment surface that, when the blade is in the sheath pocket, faces away from the handle and is located to abut the other of the blade engagement structure or the sheath engagement structure to obstruct movement of the sheath away from the handle to releasably retain the blade in the sheath pocket;

wherein at least one of the sheath engagement structure or the blade engagement structure comprises an opening and the other of the sheath engagement structure or the blade engagement structure comprises a protrusion, the protrusion being receivable in the opening to releasably retain the blade in the sheath pocket;

wherein the opening comprises a concave surface segment bounding the opening, and the protrusion is arranged to engage the concave surface segment to releasably retain the blade in the sheath pocket.

7. A knife assembly comprising:

a knife including a handle and a blade, the blade having a cutting edge;

a sheath defining a sheath pocket in which the blade is receivable for protecting the cutting edge;

wherein the blade comprises sheath engagement structure and the sheath comprises blade engagement structure, the blade engagement structure configured to engage the sheath engagement structure for releasably retaining the blade in the sheath pocket, at least one of the blade engagement structure or the sheath engagement structure including an abutment surface that, when the blade is in the sheath pocket, faces away from the handle and is located to abut the other of the blade engagement structure or the sheath engagement structure to obstruct movement of the sheath away from the handle to releasably retain the blade in the sheath pocket;

wherein at least one of the sheath engagement structure or the blade engagement structure comprises an opening and the other of the sheath engagement structure or the blade engagement structure comprises a protrusion, the protrusion being receivable in the opening to releasably retain the blade in the sheath pocket;

wherein the blade includes a bottle opener defining the opening.

8. An ulu knife for removing a bottle cap from a bottle comprising:

a handle;

a blade connected to the handle, the blade including a cutting edge and a bottle opener, the bottle opener comprising a cap receiving opening, a fulcrum portion, and a prying portion, the fulcrum portion and prying portion being arranged with respect to the cap receiving opening such that the fulcrum portion and prying portion are engageable with the bottle cap while the bottle cap is received in the cap receiving opening, the blade configured to be pivotable about the fulcrum portion while the bottle cap is received in the cap receiving opening and in engagement with the fulcrum portion to pry the bottle cap off the bottle with the prying portion.

9. An ulu knife as set forth in claim 8, wherein at least one of the fulcrum portion or the prying portion protrudes into the cap receiving opening.

10. An ulu knife as set forth in claim 9, wherein both the fulcrum portion and the prying portion protrude into the cap receiving opening.

11. An ulu knife as set forth in claim 8, wherein the fulcrum portion is arranged to engage a top of the bottle cap when the cap is received in the cap receiving opening for prying the cap off with the prying portion.

12. An ulu knife as set forth in claim 8, wherein the prying portion comprises a first protrusion protruding into the cap receiving opening and a second protrusion protruding into the cap receiving opening.

13. An ulu knife as set forth in claim 12, wherein the first and second protrusions are spaced from each other along an edge margin of the cap receiving opening.

14. An ulu knife as set forth in claim 8, wherein the handle further comprises a grip having an upper side, a lower side, a forward side, a rearward side, and opposite left and right ends, the grip having a width extending between the upper and lower sides, the grip having a length extending between the left and right ends, the blade extending widthwise of the grip downward away from the lower side of the grip to the cutting edge below the grip, the cutting edge having a length extending lengthwise with respect to the grip.

15. A knife for removing a bottle cap from a bottle comprising:

a handle;

a blade connected to the handle, the blade including a cutting edge and a bottle opener, the bottle opener comprising a cap receiving opening, a fulcrum portion, and a prying portion, the fulcrum portion and prying portion being arranged with respect to the cap receiving opening such that the fulcrum portion and prying portion are engageable with the bottle cap while the bottle cap is received in the cap receiving opening, the blade configured to be pivotable about the fulcrum portion while the bottle cap is received in the cap receiving opening and in engagement with the fulcrum portion to pry the bottle cap off the bottle with the prying portion;

the knife in combination with a sheath, the sheath configured to at least partially cover the blade when the sheath is in a covering position on the blade, the bottle opener being accessible for removing the bottle cap when the sheath is in the covering portion on the blade.

16. A knife as set forth in claim 15, wherein the sheath has a first opening by which the bottle opener is accessible when the sheath is in the covering position on the blade.

17. A knife as set forth in claim 16, wherein the sheath includes a second opening by which the bottle opener is accessible when the sheath is in the covering position on the blade, the first and second openings being on opposite sides of the sheath.

18. A knife as set forth in claim 16, wherein when the sheath is in the covering position the prying portion is exposed by the first opening.

19. A knife as set forth in claim 15, wherein the sheath includes blade connection structure configured to engage the bottle opener to releasably retain the sheath on the blade when the sheath is in the covering position on the blade.

* * * * *